US006705391B1

(12) United States Patent
Lewin

(10) Patent No.: US 6,705,391 B1
(45) Date of Patent: Mar. 16, 2004

(54) HEAT EXCHANGER

(75) Inventor: Scott J. Lewin, Pembroke Pines, FL (US)

(73) Assignees: Scott Jay Lewin, Boca Raton, FL (US); Stanley Kotler, Hialeah, FL (US); Alan H. Kepke, Hialeah, FL (US)

( * ) Notice: Subject to any disclaimer, the term of this patent is extended or adjusted under 35 U.S.C. 154(b) by 0 days.

(21) Appl. No.: 09/981,841

(22) Filed: Oct. 19, 2001

(51) Int. Cl.[7] ..... F28F 19/02; F28F 19/00; F28F 1/00

(52) U.S. Cl. ..... 165/133; 165/134.1; 165/177

(58) Field of Search ..... 165/133, 134.1, 165/177; 29/890.043, 890.046

(56) References Cited

U.S. PATENT DOCUMENTS

| | | | | | |
|---|---|---|---|---|---|
| 3,432,905 | A | * | 3/1969 | Monroe | 29/890.047 |
| 4,102,027 | A | * | 7/1978 | Greever et al. | 29/890.048 |
| 4,503,907 | A | | 3/1985 | Tanaka et al. | |
| 4,546,822 | A | | 10/1985 | Tamura | |
| 4,781,320 | A | * | 11/1988 | Fujiyoshi | 228/183 |
| 4,970,770 | A | * | 11/1990 | Jansson et al. | 29/890.044 |
| 4,998,580 | A | | 3/1991 | Guntly et al. | |
| 5,035,282 | A | | 7/1991 | Kawashita et al. | |
| 5,070,938 | A | | 12/1991 | Mizuno et al. | |
| 5,174,490 | A | | 12/1992 | Koisuka et al. | |
| 5,366,004 | A | | 11/1994 | Garner et al. | |
| 5,460,718 | A | | 10/1995 | Weck et al. | |
| 5,470,431 | A | | 11/1995 | Okuda et al. | |
| 5,747,561 | A | * | 5/1998 | Smirnov et al. | 523/212 |
| 5,806,752 | A | | 9/1998 | Van Evans et al. | |
| 6,012,511 | A | | 1/2000 | Shinmura et al. | |
| 6,036,083 | A | | 3/2000 | Luo et al. | |
| 6,102,994 | A | | 8/2000 | Zhou et al. | |

FOREIGN PATENT DOCUMENTS

| | | | |
|---|---|---|---|
| EP | 0533097 A | * | 9/1991 |
| JP | 01208696 A | * | 8/1989 |
| JP | 401316135 A | * | 12/1989 |
| JP | 11304395 A | * | 11/1999 |
| JP | 201288 A | * | 7/2001 |

* cited by examiner

*Primary Examiner*—Henry Bennett
*Assistant Examiner*—Tho Duong
(74) *Attorney, Agent, or Firm*—Lowe Hauptman Gilman & Berner, LLP

(57) ABSTRACT

A heat exchanger includes a metal fin assembly and metal tubing for carrying a heat exchange fluid. The tubing is located in passages of the assembly. Films bridge gaps between the tubing exterior surfaces and interior wall surfaces of tubes that form the passages. Exposed, exterior surfaces of the fin assembly and tubing are coated. The films and coatings are formed by electro-depositing electrically insulating powder on the heat exchanger exposed exterior surfaces. The film bridges the gap to prevent transfer of fungi and/or bacteria across the gap. The coating and film are very smooth to reduce the tendency for fungi and bacteria to accumulate. The powder can include an agent having antifungal and/or antibacterial properties.

25 Claims, 4 Drawing Sheets

HEAT EXCHANGER

FIELD OF THE INVENTION

The present invention relates generally to heat exchangers of the type including a fin assembly having passages through which tubing extends, and more particularly to such a heat exchanger wherein gaps between the tubing and the passages are bridged by films which substantially reduce the amount of fungi and bacteria associated with the heat exchanger and to a method of forming a heat exchanger including such films.

BACKGROUND ART

One common type of heat exchanger includes a fin assembly having passages through which extend tubes for carrying a heat exchange fluid. This type of heat exchanger is commonly employed, for example, in automotive air conditioners, household air conditioners and heat pumps. A known problem with such heat exchangers is that they have a tendency to accumulate and emit fungi and bacteria. The fungi and bacteria have an adverse effect and, in some instances, a devastating effect on certain persons. The problem has been addressed in the past. The prior art attempts to cure the problem have not been satisfactory to some persons who continue to have debilitating effects when exposed to the bacteria and fungi emitted by such heat exchangers.

The bacteria and fungi are associated with biofilms that accumulate on the heat exchangers; the heat exchangers can be considered as biologic or ecologic devices for this purpose. The biofilms have favorable growth conditions for microbial life, such as bacteria, fungi, yeast and small aquatic animals. The biofilms accumulate layers of living organisms, the food supply for these organisms, as well as organic and/or inorganic salts and other chemicals and/or debris. Biofilms usually occur in the presence of water and growth nutrients for organisms or a single organism. It has been discovered that biofilms exist under aluminum fin collars on copper coils, i.e. tubing, of heat exchangers of the aforementioned type. Surface cleaning liquids are not able to reach such biofilms under the aluminum fin collars.

The water in heat exchangers of domestic or automotive air conditioners or domestic heat exchangers frequently contains bacteria and fungi. Most relatively small heat exchangers employed in domestic and automotive air conditioners and domestic heat exchangers become colonized with mold and/or bacteria after two to three weeks of use. A "sweaty sock smell" is associated with such mold and/or in connection with such heat exchangers during spring and winter. This is because domestic air conditioners and heat pumps changeover at this time from heating to cooling and vice versa. Also, automotive and domestic air conditioners are usually first put into use in spring.

Most methods previously employed to reduce the odor and reduce the mold and/or bacteria count of heat exchangers of the aforementioned type involve washing the heat exchanger tubing (i.e., coil) with strong acids or alkali, deodorants, perfumes and/or disinfectants. However, such washing techniques are temporary, at best, lasting several days and requiring frequent re-application. In addition to treating the tubing with these materials, it is also necessary to treat surfaces of drain pans and drainage tubes associated with them.

The available cleansers typically have an odor and are not suitable for chemically-sensitive persons and/or have an adverse effect on the heat exchangers. For example, household bleach removes mold odor but corrodes heat exchanger fin assemblies after a few applications. The corroded fin assemblies cause the fin assembly surfaces to be roughened, thereby causing a greater adherence of mold spores to these surfaces. Many persons who suffer from the adverse effects of the bacteria and fungi associated with the mold become symptomatic within a few days after the tubing has been cleaned with bleach. Three to four days, however, is not sufficient time for the mold to regrow. Consequently, the bleach, in all likelihood, is unable to contact all heat exchanger surfaces.

It is, accordingly, an object of the present invention to provide a new and improved heat exchanger of a type including a fin assembly with passages through which tubing carrying a heat exchange fluid extends, and to a method of making same.

Another object of the present invention is to provide a new and improved heat exchanger of the aforementioned type, wherein the amount of fungi and/or bacteria emitted by the heat exchanger is substantially reduced, and to a method of making such a heat exchanger.

A further object of the present invention is to provide a new and improved heat exchanger of the aforementioned type, wherein the amount of fungi and/or bacteria emitted by the heat exchanger is reduced sufficiently to remove debilitating effects some persons have experienced with prior art heat exchangers of this type, and to a method of making such a heat exchanger.

A further object of the invention is to provide a new and improved heat exchanger of the aforementioned type, wherein gaps between the tubing and the passages of the heat exchangers are bridged with a film for preventing substantial build up and/or escape of bacteria and/or fungi, and to a method of making such a heat exchanger.

It is an additional object of the present invention to provide a new and improved heat exchanger including a fin assembly and tubing or coils, wherein the heat exchanger is constructed in such a manner as to substantially prevent the formation of biofilms on surfaces that cannot be reached by cleaning solutions, and to a method of making such a heat exchanger.

SUMMARY OF THE INVENTION

The present invention is concerned with heat exchangers of the type including (1) a metal fin assembly having passages therein, and (2) metal tubing which carries heat exchange fluid and is located in the passages, wherein the metal tubing and passages are arranged so there are gaps between exterior surfaces of the tubing and wall surfaces of the passages. In accordance with one aspect of the invention, films bridge the gaps. Preferably, the films (1) are secured to the wall surfaces of the passages and the exterior surfaces of the tubing and (2) are arranged and made of material for substantially preventing transfer of at least one of fungi and bacteria across the gaps.

Preferably, the films include an electrically insulating powder and have a thickness in the range of about 2 to 5 mils. The films are preferably formed by applying the electrically insulative powder to the gaps and the fin assembly and the tubing while (1) the powder is charged to a DC potential and (2) the fin assembly and tubing are at a DC potential sufficiently different from that of the powder to attract the powder to the fin assembly and the tubing, and by fusing the powder applied to the gaps and the fin assembly and the tubing.

While the powder is applied, the tubing and fin assembly are preferably at a temperature which causes the powder to become tacky when it contacts the tubing and fin assembly.

Preferably, exterior surfaces of the tubing outside the fin assembly and the fin assembly exterior surface are coated with the same material that forms the films, a result preferably achieved by simultaneously applying the powder that forms the coating and the film. The films preferably include a material that is at least one of an antifungicidal and antibacterial agent.

A further aspect of the invention relates to a method of forming a film to bridge a gap between a passage in a metal fin assembly of a heat exchanger and metal tubing for carrying heat exchange fluid, wherein the metal tubing extends through the passage. The method comprises applying an electrically insulating, electrically charged powder to the gap while the fin assembly and the tubing are maintained at a DC voltage which attracts the charged powder to the fin assembly and the tubing so that (1) the gap is bridged by the powder and (2) at least portions of the fin assembly and the tubing in the vicinity of the gap are coated with the powder. The powder is fused to the fin assembly and the tubing while the powder is bridging the gap.

Preferably, the tubing and fin assembly are at an elevated temperature sufficient to cause the powder to become tacky during the powder applying step.

The applying and fusing steps are preferably performed a plurality of times so that a film having a first thickness is formed the first time the applying and fusing steps are performed and the film thickness is increased the second time the applying and fusing steps are performed.

A coating in the range of about 2 to 3 mils is preferably applied to the fin assembly and the tubing during each applying step.

The powder is preferably made of a material that melts at a sufficiently low temperature as to have no substantial effect on the mechanical stability of the fin assembly or the tubing and the fusing step heats the powder to its melting temperature causing the powder on at least one of the fin assembly and tubing to melt into the gap.

In one embodiment, the powder comprises primarily urethane which is heated to approximately 375° Fahrenheit during the fusing step. The fin assembly and tubing preferably are at about 150° Fahrenheit during the applying step, a result achieved by (1) applying a cleaning solvent to the fin assembly and the tubing exterior surfaces and (2) then, immediately prior to applying the powder, drying the fin assembly and the tubing in an oven having a temperature of approximately 350° Fahrenheit.

The above and still further objects, features and advantages of the present invention will become apparent upon consideration of the following detailed description of a specific embodiment thereof, especially when taken in conjunction with the accompanying drawings.

DETAILED DESCRIPTION OF THE DRAWINGS

Figure 1:
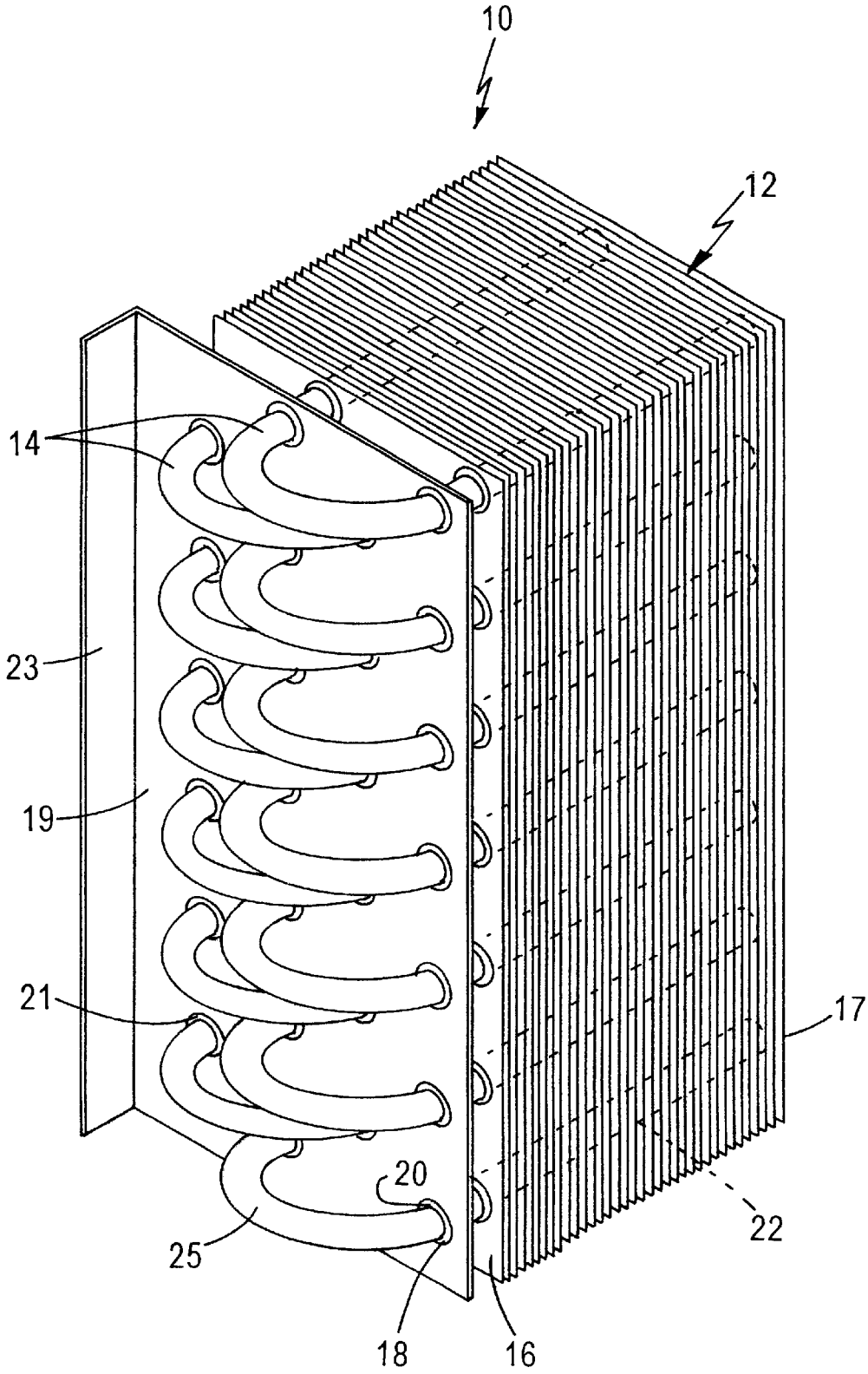
FIG. 1 is a perspective view of a heat exchanger in accordance with a preferred embodiment of the present invention.
Figure 2:
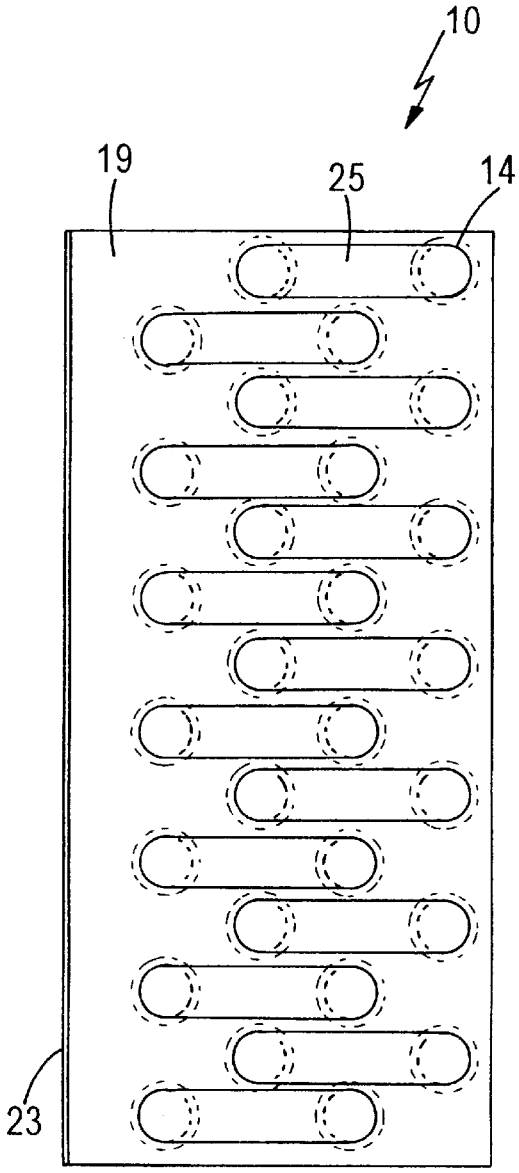
FIG. 2 is a front view of the heat exchanger illustrated in FIG. 1.
Figure 3:
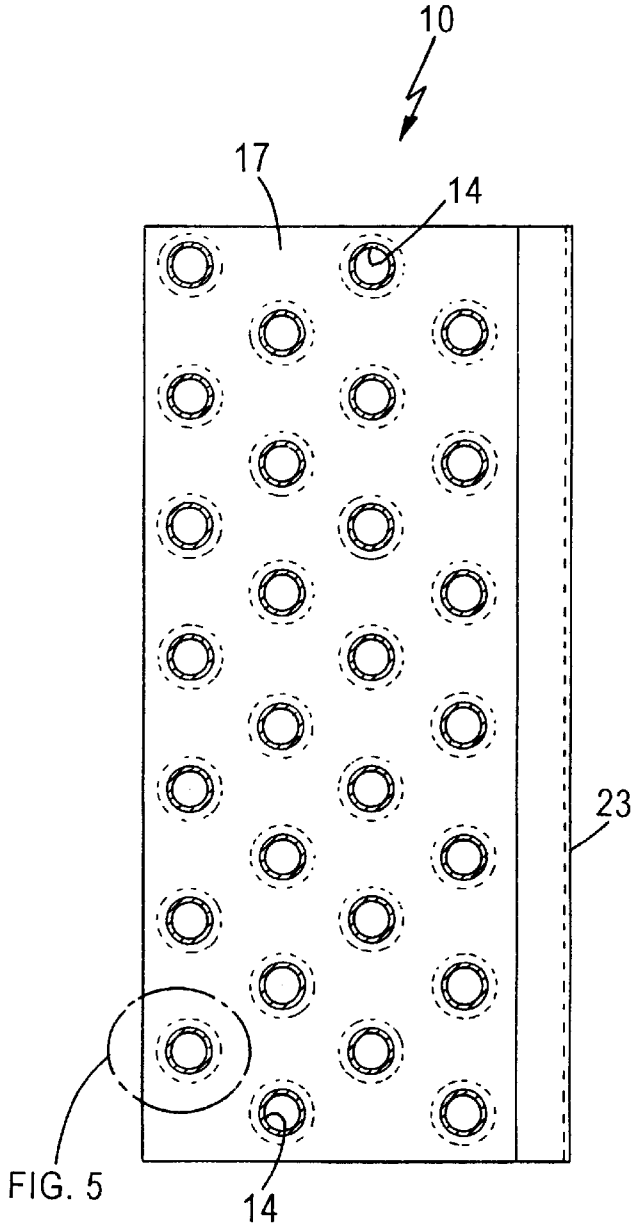
FIG. 3 is a back sectional view of the heat exchanger illustrated in FIG. 1.
Figure 4:
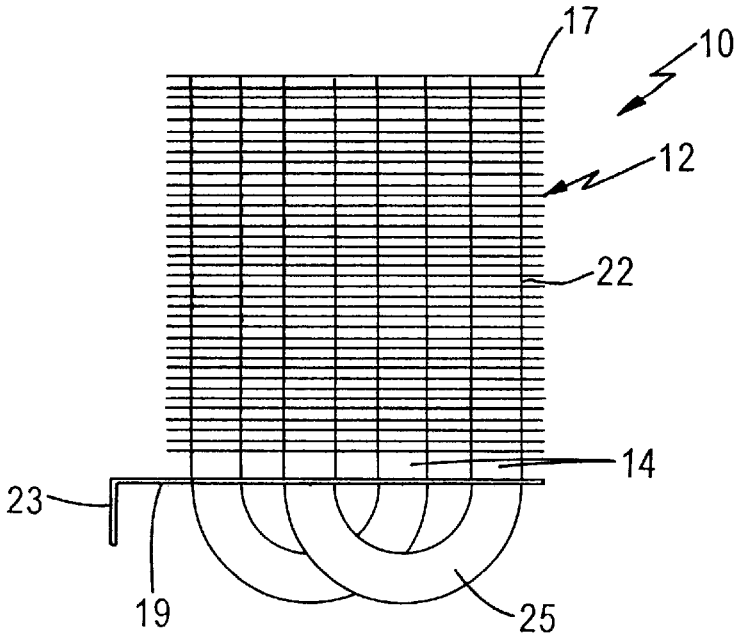
FIG. 4 is a top view of the heat exchanger illustrated in FIG. 1.

Reference is now made to FIG. 1 of the drawing, a perspective view of a heat exchanger 10 including a metal fin assembly 12, including parallel fins 13, typically made of aluminum or copper sheet metal plates, through which extends metal tubing 14, typically made of copper. A suitable heat exchange fluid (not shown) flows through tubing 14.

Fin assembly 12 includes front face 16 and a back face 17 between which extend parallel longitudinal passages 18 defined by the interior of tubes 20. Fins 13 are fixedly connected to and extend from the exterior surfaces of tubes 20, to which fins 13 are connected. Exterior edges of fins 13 on a short face of the fin assembly between front and back faces 16 and 17, are metal bonded to each other. Tubing 14 includes straight sections 22 having exterior wall surfaces 24 that are slightly spaced by a gap from the interior walls of tubes 20. The exterior wall surfaces 24 of tubing 14 and the walls of tubes 20 have circular cross sections and are substantially coaxial. Tubing 14 also includes curved portions 25 that extend beyond front face 16 of fin assembly 12. Curved portions have U shapes that extend between parallel passages 18 of fin assembly 12. Heat exchangers of the described type are frequently employed in automotive vehicle air conditioners, household air conditioners and heat pumps, as well as for other purposes.

Heat exchanger 10 also includes metal plate 19 having a flat face openings 21 aligned with passages 18 in fin assembly 12. Tubing 14 extends through the openings 21 aligned with passages 18. Curved portions 25 of tubing 14 are metal bonded by joints 25 (not shown), for example formed by welding, brazing or soldering, to plate 19. Plate 19 also includes mounting flange 23 along a side of the mounting plate that extends beyond the bottom wall of fin assembly 12. The structure described in connection with FIG. 1, to this point, is well-known.

As previously disclosed in the Background Art portion of this document, a problem with heat exchangers of the type generally illustrated in FIGS. 1–4 is that they have a tendency to accumulate biofilms and thereby emit fungi and bacteria. The fungi and bacteria severely adversely effect many persons who are allergic to them.

Figure 5:
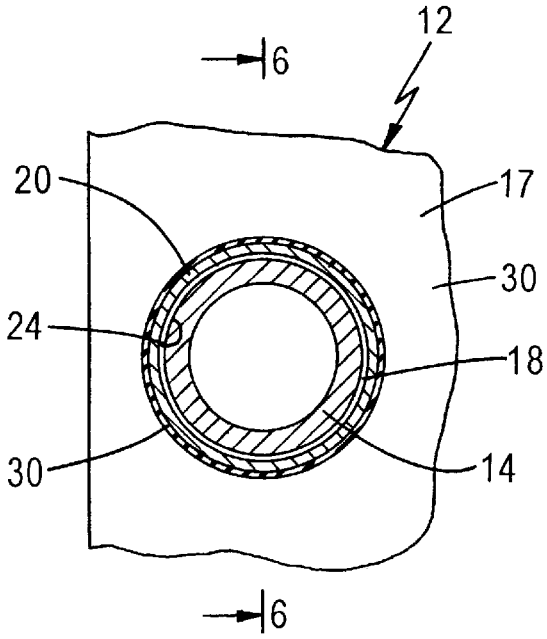
FIG. 5 is an enlarged front sectional view of a portion of the heat exchanger illustrated in FIG. 1.
Figure 6:
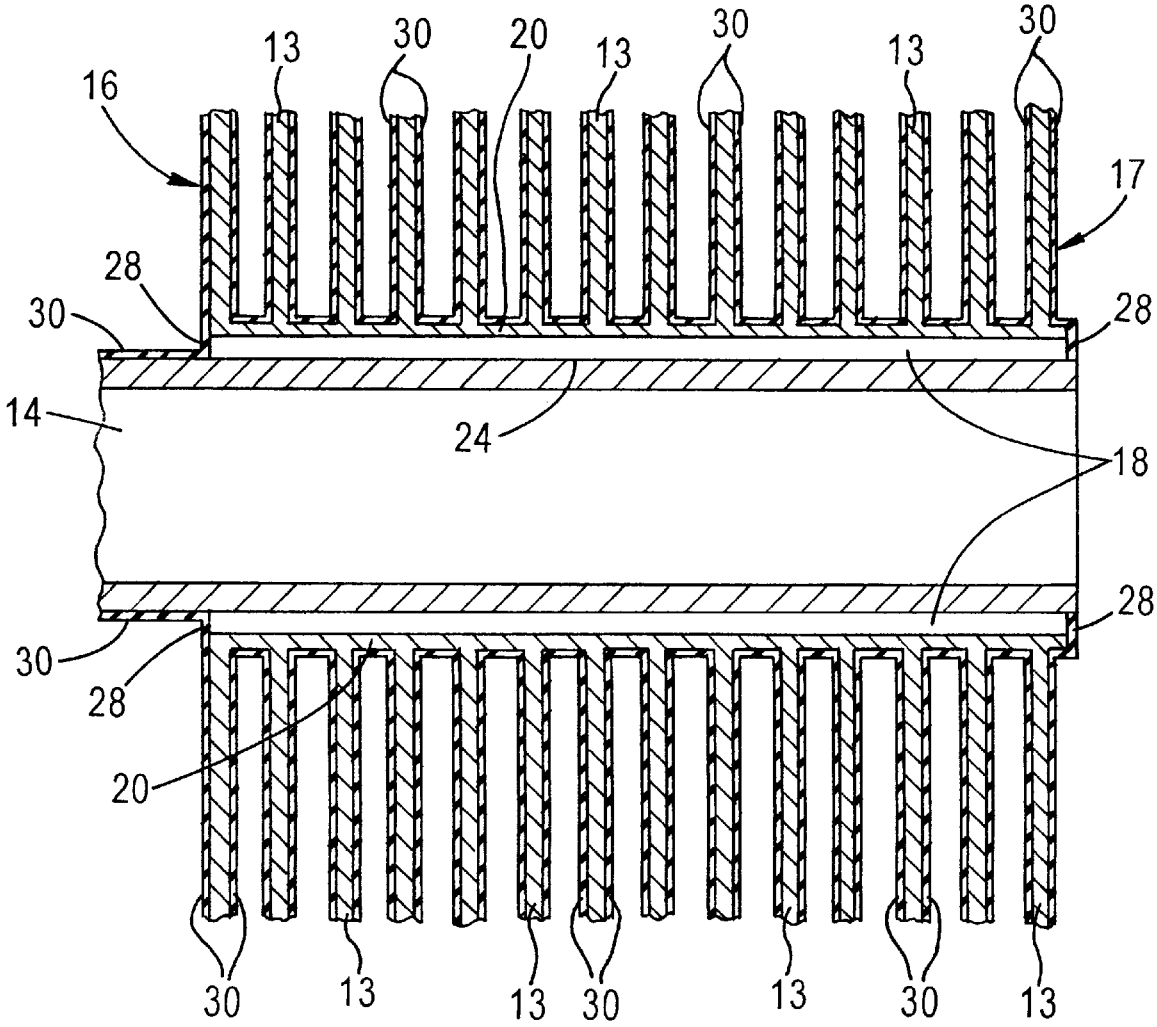
FIG. 6 is a side sectional view taken through the lines 6—6 (FIG. 5) of a portion of the fin assembly and tubing of the heat exchanger illustrated in FIG. 1.

To resolve this problem, heat exchanger 10 includes (1) film 28 (FIG. 6) that bridges the gaps on the front and back faces 16 and 17 of fin assembly 12 between (a) exterior wall surfaces 24 of tubing 14 and (b) the interior walls of tubes 20, which together define passages 18 in fin assembly 12, and (2) coating 30 (FIGS. 5 and 6) that covers all the exterior surfaces of (a) fins 13 of fin assembly 12, (b) plate 19 (including flange 23), and (c) the joints between plate 19 and tubing 14. Coating 30 also covers all the exterior wall surfaces 24 of tubing 14 that are outside fin assembly 12 and the exterior walls of tubes 20. (For purposes of illustration, the thicknesses of films 28 and coatings 30 are highly exaggerated in the drawing.)

In the preferred embodiment, film 28 and coating 30 are simultaneously applied as an electro-deposited powder. The powder is made of an electric insulating, fusible material, typically an organic compound, such as an epoxy, urethane, nylon, or a combination of two or three of these materials. In addition, the powder preferably includes a small percentage, such as 2 to 6 percent, by weight, of a biocide having antifungal, antibacterial qualities, to assist in preventing bacteria and fungi from being released into the ambient air by heat exchanger 10 during operation.

The powder is applied to fin assembly 12 and tubing 14 by applying a DC electric charge of a first polarity (preferably negative) to the electric powder while fin assembly 12 and tubing 14 are electrically grounded. To provide films and coatings having the desired properties, preferably two applications of the powder are made to fin assembly 12 and tubing 14. During the first application, fin assembly 12 and tubing 14 are coated to a thickness in the range of 2–3 mils. The powder is fused in place by being heated to approximately 375° Fahrenheit. After fusing has occurred, a second application of the same powder is made by again charging the powder to a negative DC potential while fin assembly 12 and tubing 14 are grounded. Each application of powder results in coating 30 increasing in thickness by 2–3 mils and causes films 28 to have a slightly smaller thickness, so that the thickness of films 28 as a result of two powder applications is in the range of 2 to 5 mils.

To provide heat exchanger 10 with films 28 and coating 30, the heat exchanger is initially examined for any openings which must be protected prior to the powder coating. Such openings are, for example, open ends of tubing 14 extending from rear face 17 of fin assembly 12. The openings are cleaned of any surface dirt and/or contaminants and then plugged or closed by commercially available filler plugs or tape able to withstand the high temperatures involved in the remainder of the processing operations; such materials must remain stable and not change physical characteristics at temperatures in excess of 400° Fahrenheit.

Preferably, many heat exchangers 10 are hung by metal hooks on a metal, electrically grounded chain of an automated conveyer line so the fin assembly 12 and tubing 14 of each heat exchanger are electrically grounded. The heat exchangers then sequentially pass through several processing booths. The first processing booth is a pressurized cleaner booth including a chemical cleaner such as BULK KLEEN #735A, available from Bulk Chemicals, Inc. After emerging from the first booth, each heat exchanger passes through second and third booths, both of which are pressurized clean water rinse booths. Each heat exchanger 10 then passes through a fourth booth where a pressurized spray application of another chemical cleaner, known as E-CLPS 2100, available from Bulk Chemicals, Inc., is applied to the heat exchanger. E-CLPS 2100 is a liquid including water and fluotitanic acid having a pH between 2.5 and 3.1; BULK KLEEN #735A is a concentrated, liquid etching-type metal cleaning chemical including sodium hydroxide and water.

Heat exchanger 10 then is completely dried by passing for three to five minutes through a drying oven heated to 300° Fahrenheit. To remove any lingering or trapped surface moisture, pressurized clean air is applied to each heat exchanger 10, an operation that is preferably performed by an operator holding the heat exchangers in his hand immediately after the heat exchangers come out of the oven.

Each heat exchanger 10 then proceeds on the grounded chain of the conveyer through two separate opposite facing powder coating application booths. The heat exchangers pass through the powder application booths at a temperature of about 150° Fahrenheit, as a result of residual heat from the oven. The elevated temperature of the heat exchangers while passing through the powder coating booths causes the powder, as applied, to be somewhat tacky, to assist in formation of films 28. The powder is electrostatically applied to one side and then to the other side of heat exchangers 10 as the heat exchangers pass in sequence through the two opposite facing powder coating application booths. This is the first powder coating application and results in coating 30 having a thickness between about 2 to 3 mils, i.e., approximately 50–75 micrometers, and films 28 having a thickness between about 1 to 2 mils, i.e., about 25–50 micrometers.

Each heat exchanger 10 then passes into a curing oven having an internal temperature of about 400° Fahrenheit. The heat exchangers dwell in the curing oven for between 5 and 18 minutes. The dwell time in the curing oven is a function of the surface area of the heat exchangers; some relatively large heat exchangers require in excess of 18 minutes in the curing oven. Upon emerging from the heating oven, powder coating 30 on the heat exchanger is cured and has a thickness between 2 and 3 mils and films 28 have a thickness between 1 and 2 mils.

A second powder coating is then applied to each heat exchanger 10 by reheating the heat exchanger in the drying oven at 300° Fahrenheit for between three and five minutes, then applying pressurized clean air to remove any lingering or trapped surface moisture or other possible materials on the heat exchanger that could adversely affect coating 30 or films 28. The heat exchange unit then again passes through the two separate opposite facing powder coating application booths where a second application of powder is applied to the heat exchanger so a second layer of films 28 has a thickness between 1 and 2 mils and a second layer of coating 30 has a thickness of between 2 and 3 mils. The second coating is then cured by again passing the heat exchanger through the curing oven which is again operated at about 400° Fahrenheit; the heat exchanger dwell time in the curing oven is approximately the same during the second pass as during the first pass.

When heat exchanger 10 leaves the curing oven for the second time, the coating process is completed. Hence, the total thickness of films 28 is between 2 and 4 mils and the total thickness of coatings 30 of the completed heat exchangers is between about 4 and 6 mils, i.e., about 100–150 micrometers. The thicknesses of films 28 and powder coatings 30 can be increased, if necessary, by repeating the drying, coating and curing steps or by applying somewhat thicker coatings. However, if the thickness of coating 30 during any particular application is considerably in excess of about 3 mils, there can be deleterious effects because the coating surface smoothness is reduced. It is highly advantageous for the surface coating to be as smooth as possible to reduce the likelihood of moisture being captured in portions of the coating surface that are not smooth.

After the second curing operation and just before tubing 14 of each heat exchanger 10 is connected to a source of heat exchange fluid, the plugs or tape in the openings of the tubing are removed.

An extensive test of a heat exchanger made as previously described provided exceptional results. The test was performed in connection with a person who was virtually unable to function as a result of exposure to bacteria and/or fungi emitted from conventional, prior art heat exchangers in her residence and automobile. When the heat exchangers in the residence and automobile of that person were replaced by a heat exchanger made as previously described, the person was able to function in a virtually normal manner.

No noticeable adverse effects in the efficiency of the heat exchangers including films 28 and coatings 30 were noted. This is true, despite the fact that the exposed surfaces of fin assembly 12 were coated by the cured powder. The cured powder coating 30 did not bridge a significant number of the air pockets between adjacent fins of fin assembly 12. The fins of fin assembly 12 and the tubes of tubing 14 were completely covered by powder coating 30, which enabled the surfaces of the fin assembly and the tubing to remain dry and odorless. By making the powder white, any biofilms and dirt that had a tendency to accumulate on the exposed surfaces of fin assembly 12 and tubing 14 were clearly visible and, therefore, easily removed by washing with non-toxic chemicals, such as water, odor free detergents or diluted bleaches. Because film 28 and coating 30 have smooth exterior surfaces as a result of the electrodeposition and fusing of the powder, there is low friction between the abutting exposed surfaces of heat exchanger 10, to substantially prevent the accumulation of moisture and other airborne agents on the heat exchanger exposed surfaces. Heat exchanger 10 can be installed in a conventional manner in a domestic or automotive air conditioner or a domestic heat exchanger. The coating has a long life and, as discussed previously, provides a significantly improved standard of living for patients having mold and chemical sensitivities.

While there have been described and illustrated a specific embodiment of the invention, it will be clear that variations in the details of the embodiment specifically illustrated and described may be made without departing from the true spirit and scope of the invention as defined in the appended claims.

I claim:

1. A heat exchanger comprising a metal fin assembly having passages therein, metal tubing for carrying heat exchange fluid, the metal tubing being located in the passages, the metal tubing and passages being arranged so there are radially and longitudinally extending gaps completely between opposed exterior surfaces of the tubing and wall surfaces of the passages, electrically insulating powder fused to a solid that forms films completely bridging the gaps only at opposite ends of the passages, the electrically insulating powder also being fused to form a solid that forms films adhered to exterior wall surfaces of the passages and exterior surfaces of the tubing and being arranged and made of material for substantially preventing transfer of at least one of fungi and bacteria across the gaps and accumulation of at least one of fungi and bacteria on said exterior wall surfaces and exterior tubing surfaces.

2. The heat exchanger of claim 1 wherein the films have a thickness in the range of about 2 to 4 mils.

3. The heat exchanger of claim 2 wherein the films are formed by applying electrically insulative powder to the gaps and the fin assembly and the tubing while (a) the powder is charged to a DC potential and (b) the fin assembly and tubing are at a DC potential sufficiently different from that of the powder to attract the powder to the fin assembly and the tubing and by fusing the powder while the powder is applied to the gaps and the fin assembly and the tubing.

4. The heat exchanger of claim 1 wherein the films are formed by applying electrically insulative powder to the gaps and the fin assembly and the tubing while (a) the powder is charged to a DC potential and (b) the fin assembly and tubing are at a DC potential sufficiently different from that of the powder to attract the powder to the fin assembly and the tubing and by fusing the powder while the powder is applied to the gaps and the fin assembly and the tubing.

5. The heat exchanger of claim 4 wherein the tubing and fin assembly are at a temperature while the powder is applied to the gaps as to cause the powder to become tacky when it contacts the tubing and fin assembly.

6. The heat exchanger of claim 1 wherein exterior surfaces of the tubing outside the fin assembly and the fin assembly exterior surface are coated with the same material that forms the films for substantially preventing accumulation of at least one of fungi and bacteria on the tubing outside the fin assembly and the fin assembly exterior surface.

7. The heat exchanger of claim 1 wherein the film includes a material that is at least one of an antifungicidal and an antibacterial agent.

8. The heat exchanger of claim 7 wherein the films and coating are formed by applying electrically insulative powder to the gaps and the fin assembly and the tubing while (a) the powder is charged to a DC potential and (b) the fin assembly and tubing are at a DC potential sufficiently different from that of the powder to attract the powder to the fin assembly and the tubing and by fusing the powder while the powder is applied to the gaps and the fin assembly and the tubing.

9. The heat exchanger of claim 8 wherein the films have a thickness in the range of about 2 to 4 mils.

10. The heat exchanger of claim 9 wherein the film includes a material that is an antifungicidal and an antibacterial agent.

11. The heat exchanger of claim 1 wherein the powder consists essentially of an organic compound and a small percentage of a biocide having antifungal and antibacterial qualities.

12. The heat exchanger of claim 11 wherein the biocide is about 2 to 6% by weight of the powder.

13. The heat exchanger of claim 12 wherein the organic compound is selected from at least one of an epoxy, urethane and nylon.

14. The heat exchanger of claim 11 wherein the organic compound is selected from at least one of an epoxy, urethane and nylon.

15. A heat exchanger comprising a metal fin assembly having passages therein, metal tubing for carrying heat exchange fluid, the metal tubing being located in the passages, the fin assembly passages and the tubing being arranged so there are radially and longitudinally extending taps completely between opposed exterior surfaces of the tubing and wall surfaces of the passages, and solid films completely bridging the gaps only at opposite ends of the passages.

16. The heat exchanger of claim 15 wherein the films are formed of an electrically insulating material.

17. The heat exchanger of claim 16 wherein the films include a material that is at least one of an antifungicidal and an antibacterial agent.

18. The heat exchanger of claim 16 wherein the films are formed by electro-depositing and fusing an electrically insulating powder to bridge the gaps.

19. The heat exchanger of claim 18 wherein the films are electro-deposited by applying electrical charge of a first polarity to the powder while the tubing and the fin assembly are maintained at a voltage which attracts the charged powder to them and by fusing the powder while the powder is applied to the gaps.

20. The heat exchanger of claim 19 wherein the tubing and fin assembly are at a temperature while the powder is applied to the saps to cause the powder to become tacky when it contacts the tubing and fin assembly.

21. The heat exchanger of claim 15 wherein the film is made of a material and is arranged for substantially preventing at least one of bacteria and fungi from crossing the gap.

22. The heat exchanger of claim 21 wherein the film includes a material that is at least one of an antifungicidal and an antibacterial agent.

23. The heat exchanger of claim 15 wherein the films have a thickness in the range of about 2 to 4 mils.

24. The heat exchanger of claim 15 wherein exterior surfaces of the tubing outside the fin assembly and the fin assembly exterior surface are coated with the same material that forms the films.

25. The heat exchanger of claim 15 wherein the film includes a material that is an anti fungicidal and an antibacterial agent.

* * * * *